US006283024B1

(12) United States Patent
George

(10) Patent No.: US 6,283,024 B1
(45) Date of Patent: Sep. 4, 2001

(54) QUICK CHANGE PRINT STATION FOR CENTRAL IMPRESSION PRESSES

(75) Inventor: John George, Meriden, KS (US)

(73) Assignee: Express Card & Label Co., Inc., Topeka, KS (US)

( * ) Notice: Subject to any disclaimer, the term of this patent is extended or adjusted under 35 U.S.C. 154(b) by 0 days.

(21) Appl. No.: 09/282,974

(22) Filed: Mar. 31, 1999

(51) Int. Cl.[7] ..... B41F 5/16; B41F 5/18; B41F 13/24

(52) U.S. Cl. ..... 101/182; 101/185; 101/184; 101/247

(58) Field of Search ..... 101/175, 176, 101/247, 216, 139, 140, 143–145, 182, 184, 185, 218, 183, 181

(56) References Cited

U.S. PATENT DOCUMENTS

| | | | | |
|---|---|---|---|---|
| 2,012,245 | * | 8/1935 | Meisel | 101/178 |
| 3,625,145 | * | 12/1971 | Heatley, Jr. et al. | 101/152 |
| 3,952,610 | * | 4/1976 | Hope et al. | 74/421 |
| 4,231,292 | * | 11/1980 | Stolle | 101/137 |
| 4,309,945 | | 1/1982 | Marion . | |
| 4,413,560 | * | 11/1983 | Rogge | 101/247 |
| 4,488,483 | * | 12/1984 | Kohara | 101/178 |
| 4,774,883 | * | 10/1988 | Mailander | 101/137 |
| 4,878,427 | * | 11/1989 | Waschynsky et al. | 101/219 |
| 5,125,339 | * | 6/1992 | Rogge | 101/247 |
| 5,345,865 | * | 9/1994 | Kemp | 101/349 |
| 5,585,124 | * | 12/1996 | Bittner | 425/331 |
| 5,787,811 | * | 8/1998 | Achelpohl et al. | 101/349.1 |
| 6,038,972 | * | 3/2000 | Delwiche et al. | 101/216 |

OTHER PUBLICATIONS

"FLEXOGRAPHY: Principles and Practices", Flexographic Technical Association, Inc., 1rst ed., 1962.*

* cited by examiner

*Primary Examiner*—Kimberly L. Asher
(74) *Attorney, Agent, or Firm*—Kyle L. Elliott; Blackwell Sanders Peper Martin LLP

(57) ABSTRACT

A central impression printing press (20) utilizes a plurality of quick change print stations (100, 200, 300) to increase safety and print quality. The print stations (100, 200, 300) include movable carriages (102, 202, 302) which mount anilox rolls (40) and meter rolls (38). The carriages (102, 202, 302) roll on guide track assemblies (104, 204, 304) and are locked in operative positions by lock mechanisms (106, 206, 306) utilizing lock arms (1100, 316) with progressive engagement surfaces (1106, 318). The carriages (102, 202, 203) have anilox roll mounts (132) and mounting slots (134) which allow the anilox rolls (40) and meter rolls (38), respectively, to be simply lifted off the carriages (102, 202, 203). The anilox rolls (40) are driven by engagement of a shear pin (160) which shears off if foreign matter becomes caught in the rolls. The press (20) also uses an upstream doctor blade (1126) used on the upstream print station (102).

5 Claims, 7 Drawing Sheets

QUICK CHANGE PRINT STATION FOR CENTRAL IMPRESSION PRESSES

TECHNICAL FIELD

This invention relates to printing presses and, more particularly, to central impression flexographic printing presses having quick change print stations and upstream side print station doctor blades.

BACKGROUND

Central impression printing presses, which have been used for many years, are characterized by a central impression cylinder with a plurality of print stations spaced around the central impression cylinder. Each print station typically includes a meter roll, an anilox roll, and a print roll. These types of printing presses are preferred because they maintain relatively precise registration of the printed material. Typical central impression presses include three to eight print stations and have a web width ranging from approximately four to sixty inches. To support the central impression cylinder and the print stations while maintaining registration with the desired precision, central impression presses utilize substantially fixed and continuous opposing side walls to support the central impression cylinder and the print stations. The side walls typically enclose the sides of the print stations thereby substantially inhibiting access to the central impression cylinder and the print stations.

At several points during a printing process and at the conclusion of a printing job, the printing press operator must clean and/or change the rolls in one or more of the print stations. In currently available central impression presses, it takes an inordinate amount of time to remove the anilox and meter rolls for cleaning or replacement with different rolls for a different job. Because it takes so long to remove the rolls for cleaning or to change the rolls, operators are encouraged to risk potentially severe injury by cleaning the rolls while they are still in the press, and occasionally operators sacrifice print quality by not changing the rolls when required for the next printing job.

More specifically, when cleaning the rolls while in the press, operators risk pinching their fingers between rolls. To clean rolls around their entire circumference, operators jog, that is incrementally rotate, the rolls or leave the rolls rotating while holding a cloth against the roll with their hands. As expected, cloths and fingers occasionally get caught between rolls, and when a finger gets caught, the finger is severely injured or even lost. As to print quality, cleaning the rolls with cloths is not as effective as rinsing them in wash basins. Also, anilox rolls are provided with different cell configurations and concentrations to control the amount of ink that is transferred to the print roll for application to the web which passes between the central impression cylinder and the print rolls. If the anilox roll already in the press is close in cell configuration and concentration to the anilox roll required for the next print job, operators are tempted to save time by using the anilox roll from the previous print job thereby diminishing the print quality.

Doctor blades are also used to further improve print quality by more accurately metering the amount of ink transferred to the print rolls. The doctor blades scrape against the anilox rolls to remove excess ink. For doctor blades to be effective, they must be positioned between the meter rolls and the print rolls to scrape the anilox rolls after they are inked by the meter rolls and before the anilox rolls transfer their ink to the print rolls. For print stations on the downstream side of the central cylinder, the doctor blades are positioned opposite to the central cylinder, but for print stations on the upstream side of the central cylinder, the doctor blades must be positioned between the print station and the central cylinder. Thus, the upstream doctor blades would be inaccessible to an operator making it commercially unfeasible to use doctor blades on upstream print stations.

SUMMARY OF THE INVENTION

Accordingly, one object of the present invention is to provide an improved quick change print station.

It is another object of the present invention to provide an improved central impression press having quick change print stations.

It is still another object of the present invention to provide an improved upstream print station assembly having a doctor blade.

It is a further object of the present invention to provide an improved print station which reduces the risk of injury.

In carrying out the foregoing and other objects, the present invention contemplates an improved quick change print station for a central impression printing press. The press includes a central impression cylinder and at least two quick change print stations. The quick change print stations include a plurality of rotating rolls with at least one of the rolls mounted on a movable carriage which is movable between retracted and operative positions.

In a preferred embodiment, the press has substantially fixed and continuous side walls, and the movable carriages are retracted in a direction substantially parallel to a longitudinal axis of the press. Preferably, each carriage holds an ink tray, an anilox roll, and a meter roll. The carriages include anilox roll mounts which are preferably less than half a circle and meter roll mounting slots which are open at one end allowing both the anilox roll and the meter roll to be simply lifted off the carriage. When the carriages are in the operative positions, the anilox rolls are held in place by bearing stops extending from bushings mounted in the side walls of the press. The anilox rolls are driven by engagement of a shear pin which shears off if a finger or a cloth become caught in the rolls. The carriages are locked in place by lock mechanisms which utilize lock arms with engagement surfaces configured to progressively engage cylindrical lock shafts of the carriages and urge the carriages into their operative positions. Each print station is also provided with a guide track assembly having a fixed guide track and a removable guide track extension.

The invention also contemplates use of an upstream doctor blade on an upstream print station of a central impression printing press. The doctor blade is preferably positioned between the central cylinder of the press and the anilox roll and engages the anilox roll after the anilox roll is inked by the meter roll but before the anilox roll transfers ink to the print roll. The upstream doctor blade is preferably provided with two adjustments; one of the adjustments allows the blade to be adjusted without moving the carriage.

The invention further contemplates using the described quick change print stations in a method for cleaning or changing components of a printing press print station. The method is performed by unlocking a movable carriage, moving the carriage to a retracted position, and lifting the anilox roll off the carriage. Preferably, the meter roll is also lifted off the carriage for cleaning. The carriage is preferably rolled to the retracted position.

DETAILED DESCRIPTION

Figure 1:
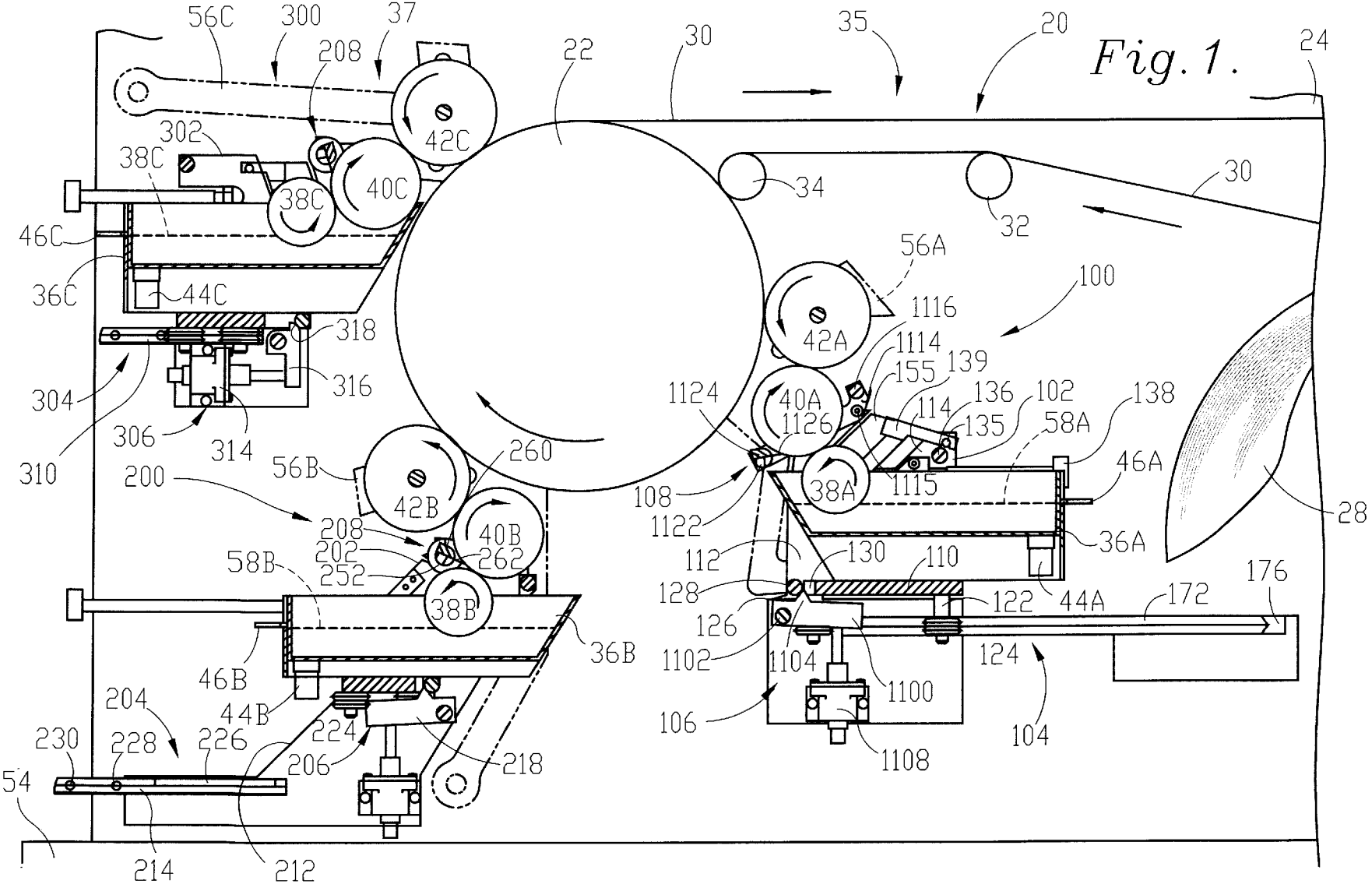
FIG. 1 is a fragmentary side view of a central impression printing press having quick change print stations according to the present invention and illustrating operation of the printing press.
Figure 2:
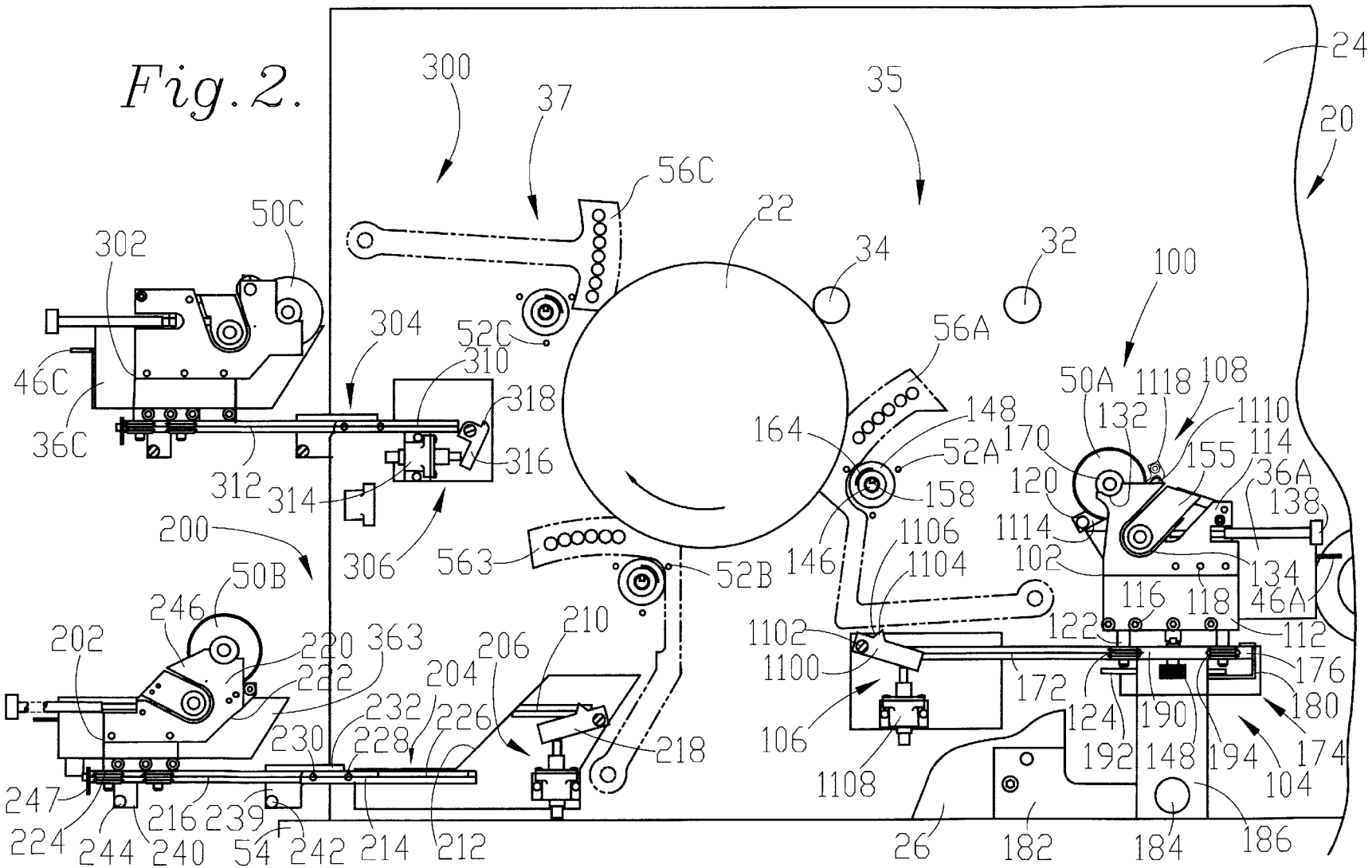
FIG. 2 is a fragmentary side view of the central impression printing press of FIG. 1 showing the quick change print stations in retracted positions.

Referring to the drawings in greater detail, FIGS. 1 and 2 illustrate a central impression printing press 20 including a rotating central impression cylinder 22, three quick change print stations 100, 200, 300, and opposed side walls 24, 26 mounting the central cylinder 22 and print stations 100, 200, 300 therebetween. Each of the print stations 100, 200, 300 is operatively positioned relative to the central cylinder 22 and has a movable carriage 102, 202, 302 which can be quickly removed to the positions shown in FIG. 2 for cleaning or printing job changes.

The printing press 20 includes a feed roll 28 which feeds a web 30 over a guide roll 32 and between the central cylinder 22 and a nip roll 34. As the web 30 moves around the central cylinder 22, the print stations 100, 200, 300 apply ink to the web 30 which then moves to a take up roll (not shown). To achieve the desired registration of the matter printed by each of the print stations, the preferred side walls 24, 26 are substantially fixed and continuous. These preferred side walls substantially inhibit operator access to the rolls because the extremities of the walls extend beyond the print stations as seen in FIG 1. Arrows are provided in FIG. 1 to illustrate the direction of web movement and the directions in which the various rolls of the press rotate. The print stations are referred to by the order in which they apply ink to the web. Thus, in the printing press 20 illustrated, the right print station is station number one 100; the lower print station is station number two 200, and the upper print station is station number three 300. Each of the three quick change print stations will be described in order with repetitive material being omitted as appropriate for the description of the second and third print stations. Identical reference numerals, differentiated by the suffixes A for station one, B for station two, and C for station three, will be used for some of the related components of the three quick change print stations.

Figures 3, 4, 12, 13, 14:
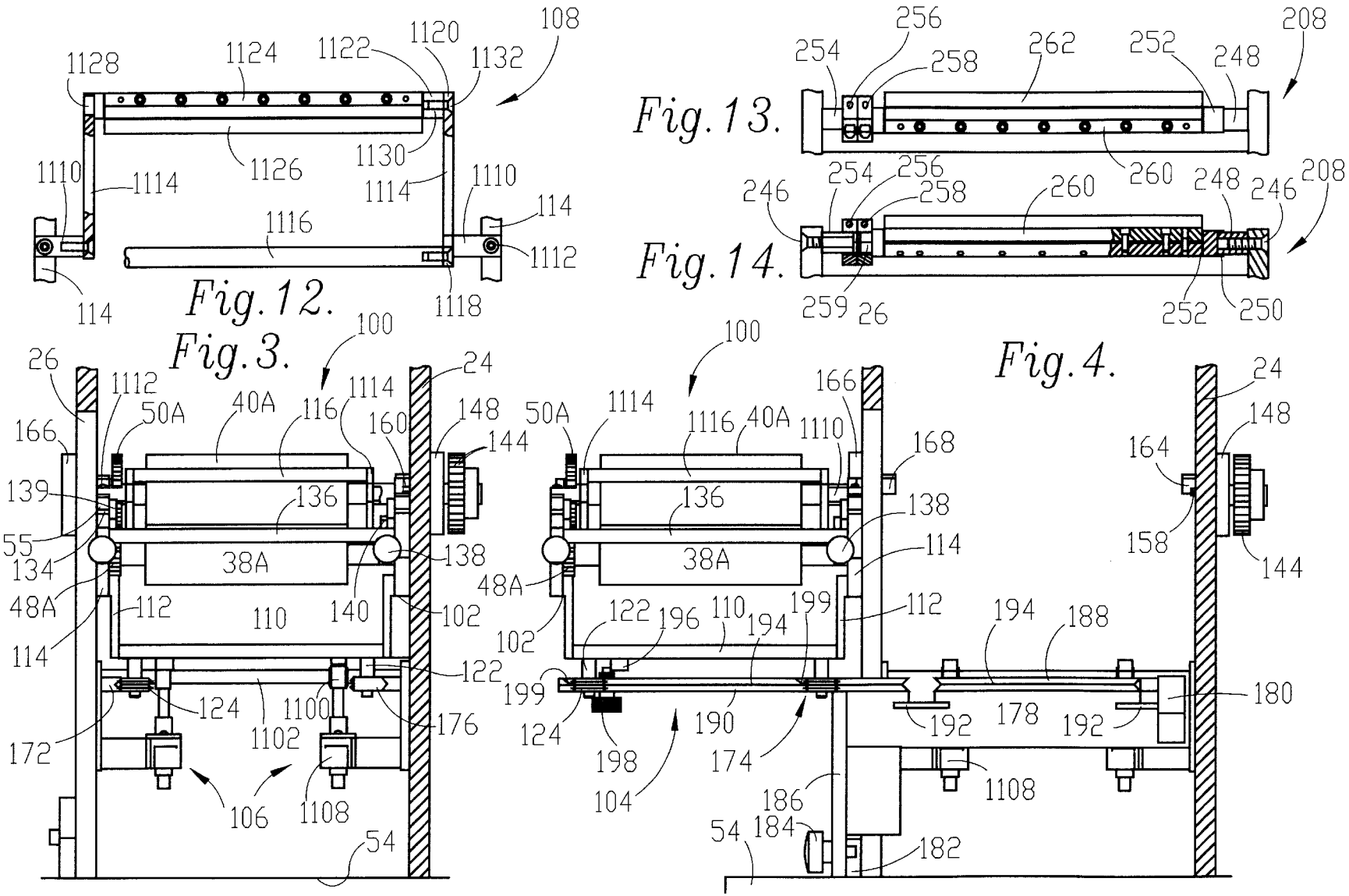
FIG. 3 is a fragmentary rear view of a number one print station having a movable carriage illustrated in an operative position.
FIG. 4 is a fragmentary rear view of the number one print station shown in FIG. 3 with the carriage in a removed position.
FIG. 12 is a fragmentary top view in partial cross section of an upstream doctor blade assembly used with the number one print station of FIG. 3.
FIG. 13 is a top view of an alternate doctor blade assembly used with print stations number two and number three.
FIG. 14 is a blade end view in partial cross sectional of the doctor blade assembly of FIG. 13.

Referring to FIGS. 2, 3, and 4, print station number one 100 is an upstream print station positioned on an upstream side 35 of the central cylinder 22, and it includes the movable carriage 102 which supports an ink tray 36A, a meter roll 38A, and an anilox roll 40A. The movable carriage 102 is supported by a guide track assembly 104 and selectively held in an operative position by a lock mechanism 106. The first print station 100 also includes a doctor blade assembly 108 adjustably mounted on the carriage 102, and a print roll 42A adjustably mounted on the side walls 24, 26 of the press 20.

Referring to FIGS. 6–10, the first movable carriage assembly 102 includes a bottom plate 110, opposed side plates 112, and opposed side plate extensions 114. The side plates 112 are attached to the bottom plate 110 by a plurality of lower fasteners 116, and the side plate extensions 114 are attached to the side plates 112 by a plurality of upper fasteners 118. The bottom plate 110 defines four openings 120 for attachment of four cylindrical wheel legs 122 which extend downwardly from the bottom plate 110. Wheels 124 are rotatably mounted on the wheel legs 122 such that their axes of rotation are perpendicular to the plane of the bottom plate. Thus, the wheels 124 rotate in a substantially horizontal plane. The perimeters of the wheels have generally M-shaped configurations for engagement with the guide track assembly 104. The side plates 112 include downwardly extending and forwardly positioned shaft mounting legs 126 which support a cylindrical lock shaft 128 therebetween for engagement by the lock mechanism 106. The shaft mounting legs 126 are spaced apart from the bottom plate to define a locking gap 130 therebetween which allows the lock mechanism 106 to engage the lock shaft 128.

The side plate extensions 114 define circular bearing seats 132 which form an anilox roll mount to support the anilox roll 40A. The anilox roll mounts 132 are preferably less than a half circle, so that the anilox roll 40A simply rests on the bearing seats and can be manually lifted off of the carriage 102. The plate extensions 114 also define open ended, meter roll mounting slots 134 and have short pivot shafts 135 extending inwardly to adjustably mount the meter roll 38A. A spacer bar 136 extends between the opposed to plate extensions 114 to provide sufficient rigidity to the carriage 102. The lock shaft 128 also operates as a spacer to strengthen the carriage. Depending on space constraints within the press, meter roll nip adjustment screws 138 are threaded through either the extensions 114 or an adjustment block 140 mounted on the inside surface of the extensions 114. In the embodiment shown, the adjustment block 140 is attached to the extension which is adjacent the inner side wall 24 of the press. The adjustment screws 138 indirectly engage the meter roll 38A to adjust the nip between the meter roll 38A and the anilox roll 40A.

The ink tray 36A is supported on the bottom plate 110 between the plates 112 and plate extensions 114. The ink tray includes a bottom drain 44A from which a drain tube (not shown) extends. During operation, the drain tube is crimped and held in a tube holder 46A provided on the ink tray 36A.

The meter roll 38A extends into the ink tray 36A and is supported on the carriage by opposed mounting plates 155 configured to adjustably move within the confines of the mounting slots 134 of the plate extensions 114. Mounting arms 139 having pivot recesses 141 and are attached to the mounting plates 155. The pivot recesses 141 pivotally engage the short pivot shafts 135. The adjustment screws 138 contact the opposed mounting plates 155, and by threading the adjustment screws in and out as desired, the mounting plates and meter roll are moved toward and away from, respectively, the anilox roll 40A. The mounting arms 139 pivot on the short pivot shafts 135, and there is sufficient clearance between the mounting plates and the mounting slots to permit adjustment. For the adjustment screw threaded through the adjustment block 140, an adjustment shoulder 142 is attached to the inner surface of the mounting plate 155 adjacent to the inner side wall 24. The adjustment screw then contacts the adjustment shoulder 142 instead of the mounting plate.

Figure 7:
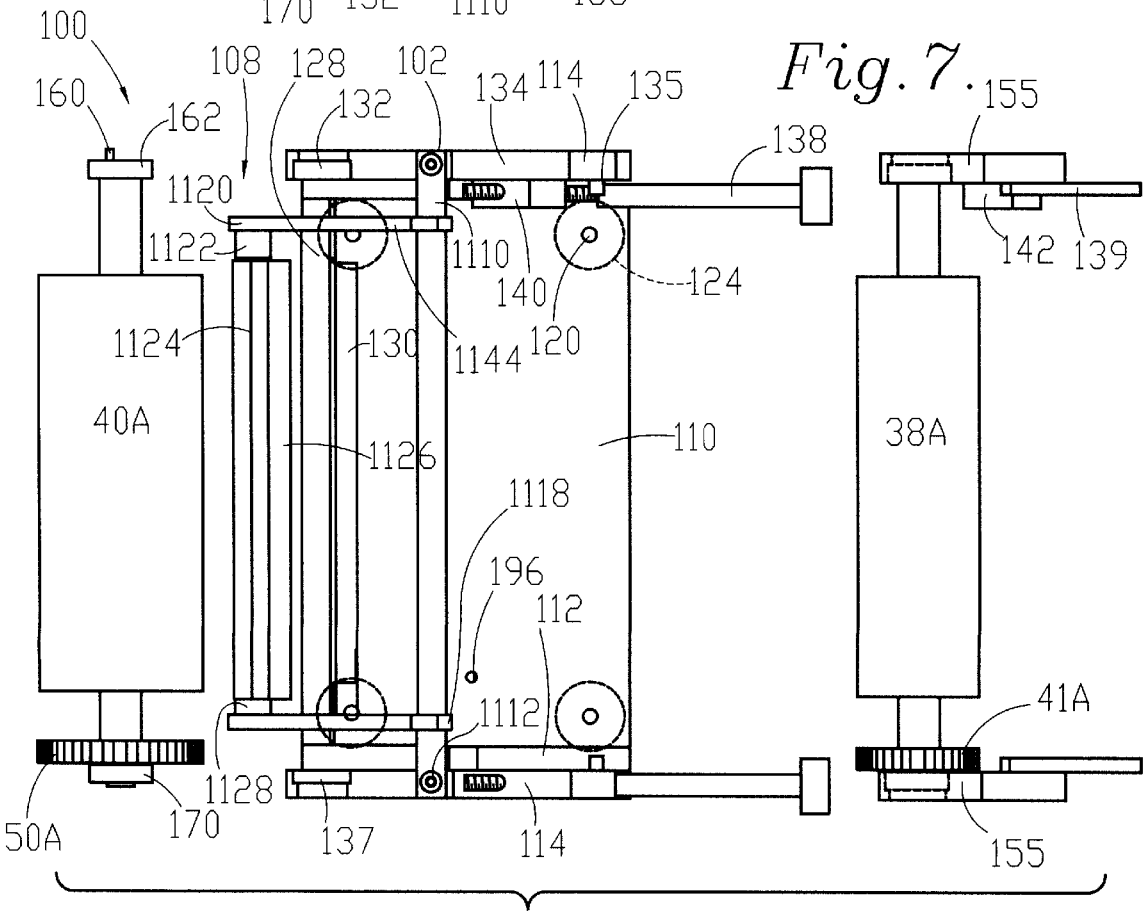
FIG. 7 is an exploded top view of the number one print station of FIG. 3.
Figure 11:
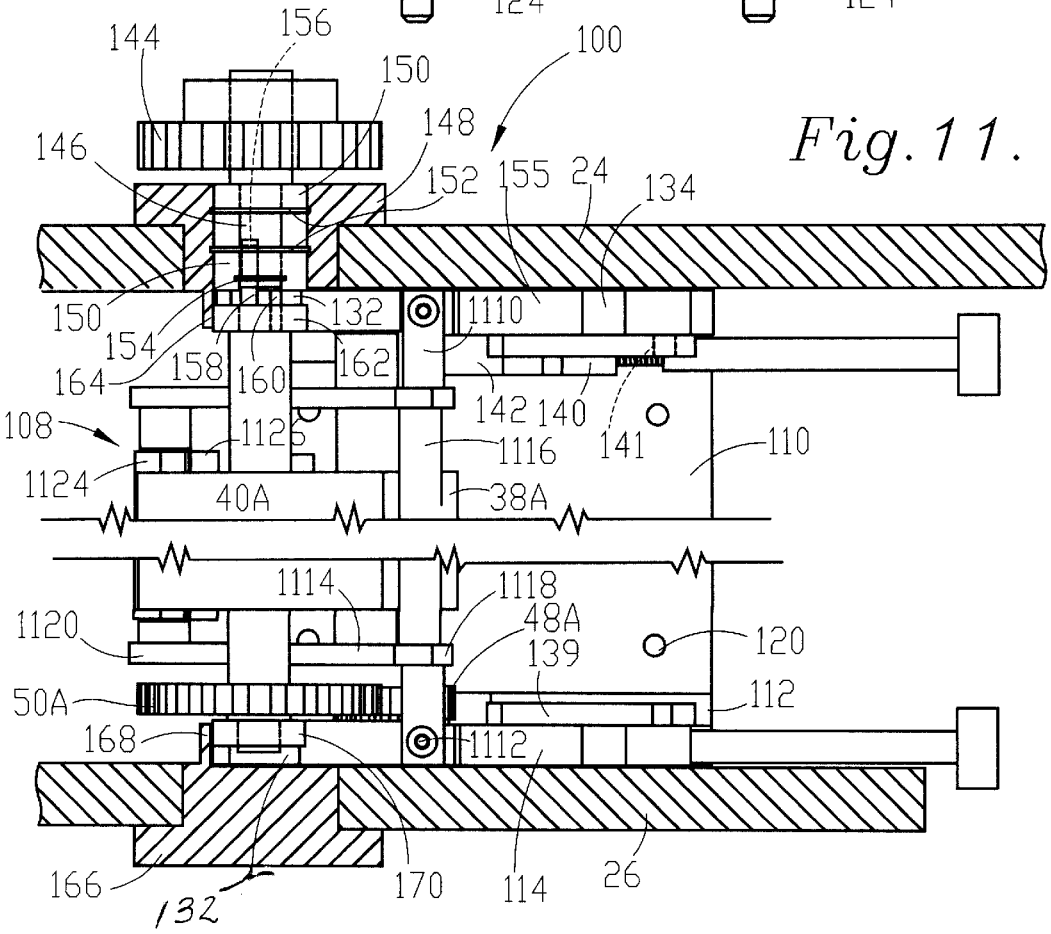
FIG. 11 is a top fragmentary cross sectional view of the number one print station of FIG. 3 and its shear pin drive assembly.

Referring to FIGS. 3, 7, and 11, the meter roll is rotationally driven by a meter roll gear 48A which meshes with an anilox roll gear 50A adjacent to the outer side wall 26 of the press. The anilox roll 40A is driven by a drive gear 144 positioned on the opposite side of the inner side wall 24 from the anilox roll 40A. Power is transmitted from the drive gear 144 to a stub drive shaft 146 extending through the inner side wall 24. The drive gear is in communication with a constant drive motor (not shown) which rotates the anilox roll and meter roll even when the press is stopped to inhibit ink from drying on the meter and anilox rolls. The stub shaft 146 is positioned by an inner bushing 148 extending through the inner side wall and mounted thereto with fasteners extending through mounting holes 52A (FIG. 2) formed in the side wall 24. A pair of bearings 150, held in position by three snap rings 152, 154, rotationally mounts the stub shaft 146 within the bushing 148. The inner snap rings 152 engage the inner surface of the bushing 148, and the outer snap ring 154 engages the outer surface of the stub shaft 146. The stub shaft 146 defines a key way 156 which receives a drive key 158 therein.

The drive key 158 extends inwardly from the side wall 24 toward the anilox roll 40A, and as the drive key 158 is rotated, it contacts a radially aligned shear pin 160 which is coupled with the anilox roll. The shear pin 160 extends through an inner anilox bearing 162 and is fabricated from a relatively weak material, so that if an operator's finger gets caught, the shear pin 160 is sheared off by the drive key 158 thereby protecting the operator from severe injury. The inner bushing 148 also includes an inner bearing stop 164 extending inwardly from the bushing 148 and the side wall 24. The bearing seat 132 adjacent the inner side wall 24 and the inner bearing stop 164 cooperate to hold the inner anilox bearing 162 therebetween. An outer bushing 166 is attached to the outer side wall 26 and includes an outer bearing stop 168 which cooperates with the bearing seat 132 adjacent the outer side wall 26 to hold an outer anilox bearing 170 to substantially fix the axial position of the anilox roll while allowing rotation of the anilox roll. When the carriage is moved from the operative position to the retracted position spaced apart from the central cylinder 22, the anilox bearings 162, 170 are simply resting in the bearing seats 132, so that the anilox roll can be lifted away from the carriage. Similarly, the meter roll is simply lifted upwardly removing the mounting plates 155 from the open ended mounting slots 134.

Figure 5:
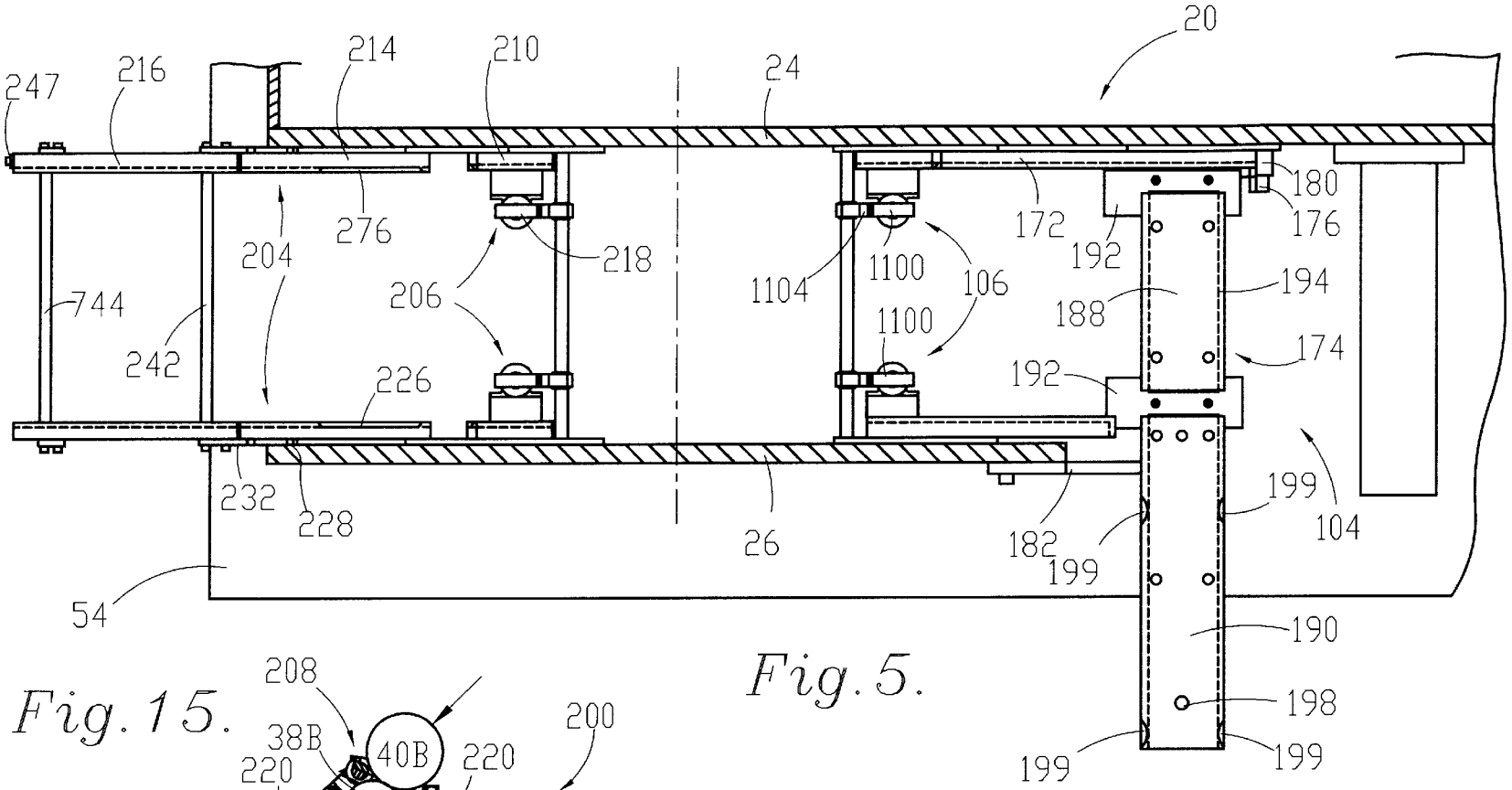
FIG. 5 is fragmentary top view in cross section illustrating guide track assemblies and lock mechanism of the print stations.

Referring to FIGS. 2, 4, and 5, the guide track assembly 104, which supports the movable carriage 102, includes a fixed guide track portion 172 and a removable guide track extension portion 174. The guide tracks 172, 174 are generally V-shaped to receive the outer legs of the M-shaped perimeters of the wheels 124. The opposed guide tracks 172 are attached to the inside surfaces of the side walls 24, 26 and extend substantially parallel to a longitudinal axis of the printing press 20. A wheel stop 176 is positioned at the end of the guide track that is attached to the inner side wall 24 to engage a rear inner one of the wheels 124 and keep the carriage from falling off the guide track assembly 104 after it has moved parallel to the longitudinal axis of the printing press to the retracted position spaced away from the central cylinder 22.

The removable guide track 174 forms an extension allowing the first movable carriage to be moved perpendicular to the longitudinal axis of the printing press allowing full access to the carriage 102. The removable guide track has an extension platform 178 with a hook 180 which hooks over the fixed guide track 172 at the same location as the wheel stop 176. The platform 178 rests on a base 54 of the press and is further held in position by a guide mounting plate 182 attached to the outer side wall 26 of the press. An extension fastener 184 attaches a leg 186 of the platform 178 to the extension mounting plate 182. A first top plate 188 is attached to the top of the platform 178. The first top plate 188 is spaced apart from the inner side wall 24 to allow a rear inner one of the wheels 124 to pass by. A second top plate 190 is also attached to the platform 178. The second top plate 190 is spaced apart from the first top plate 188 to allow a rear outer one of the wheels 124 to pass between the top plates 188, 190. Alignment plates 192 are positioned at the passageway between the first top plate and the inner side wall and at the passageway between the top plates. The bottoms of the wheel legs 122 slide on the alignment plates to keep the wheels 124 aligned with the V-shaped grooves 194 on the outer edges of the top plates 188, 190.

To inhibit the carriage 102 from coming off the free end of the second top plate 190, a carriage stop 196 is attached to the underneath side of the bottom plate 110, and a spring loaded retractable pin 198 extends upwardly through the second top plate 190 to engage the carriage stop 196. By pulling on the retractable pin 198, the carriage stop 196 can pass by allowing the wheels 124 to be aligned with wheel openings 199 in the tops of the guide tracks 194 of the second top plate 190. Once the wheels are aligned with the wheel openings 199, the carriage 102 can be lifted off the removable guide track 174.

Figure 9:
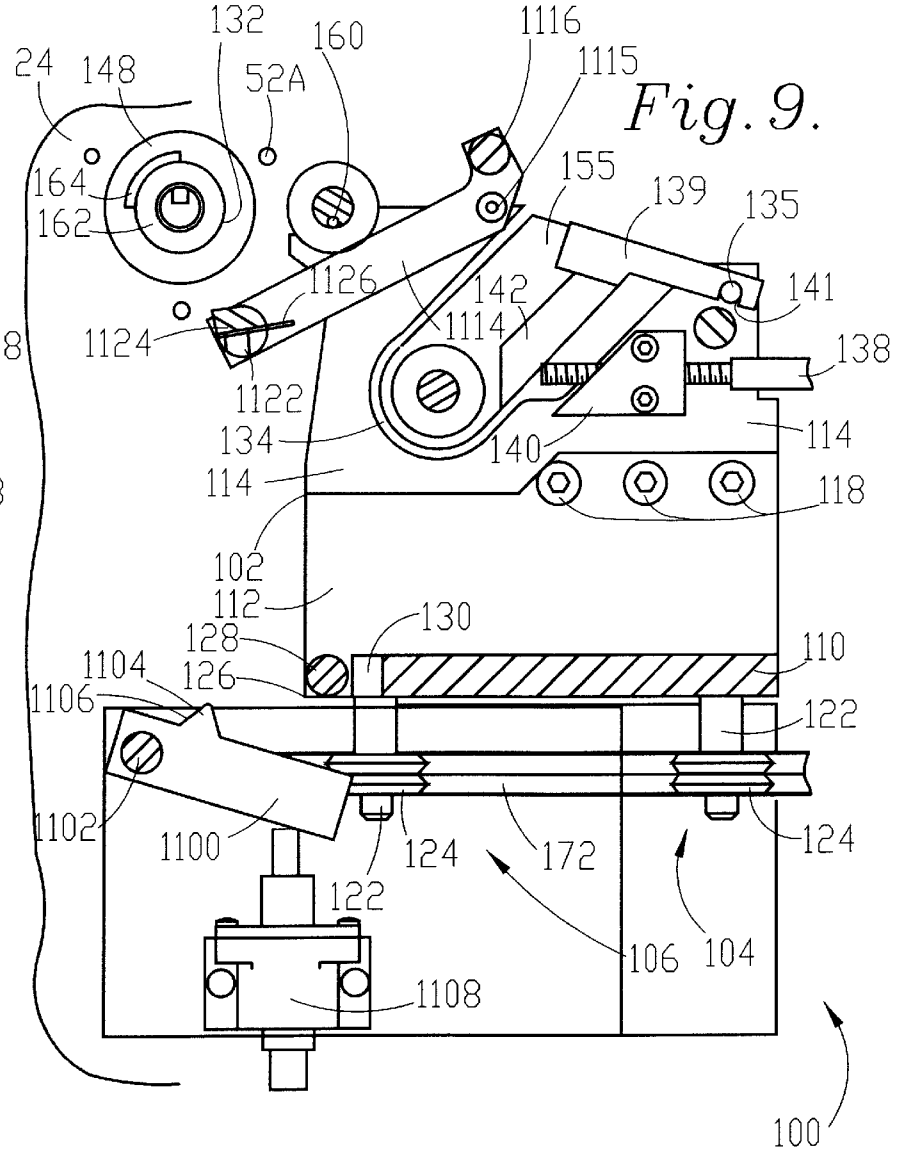
FIG. 9 is a slightly enlarged side view in cross section of the number one print station carriage of FIG. 3 shown moving toward a retracted position.
Figure 8:
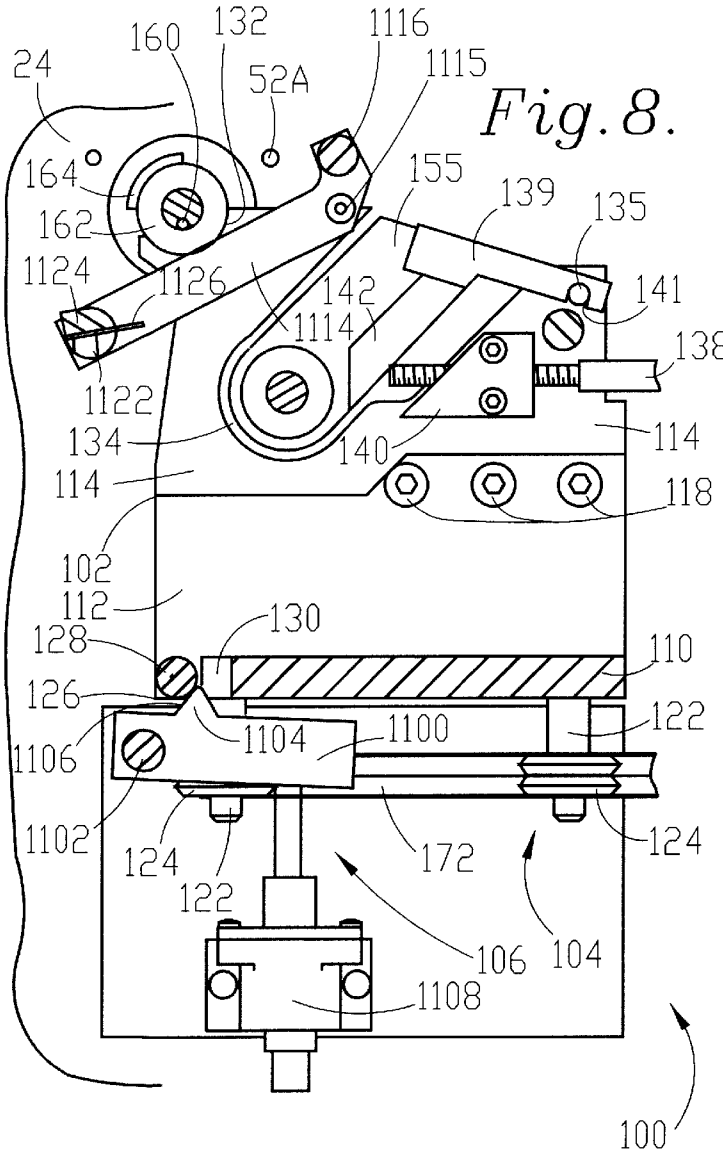
FIG. 8 is a slightly enlarged side view in cross section of the number one print station carriage of FIG. 3 shown in an operative position.
Figure 10:
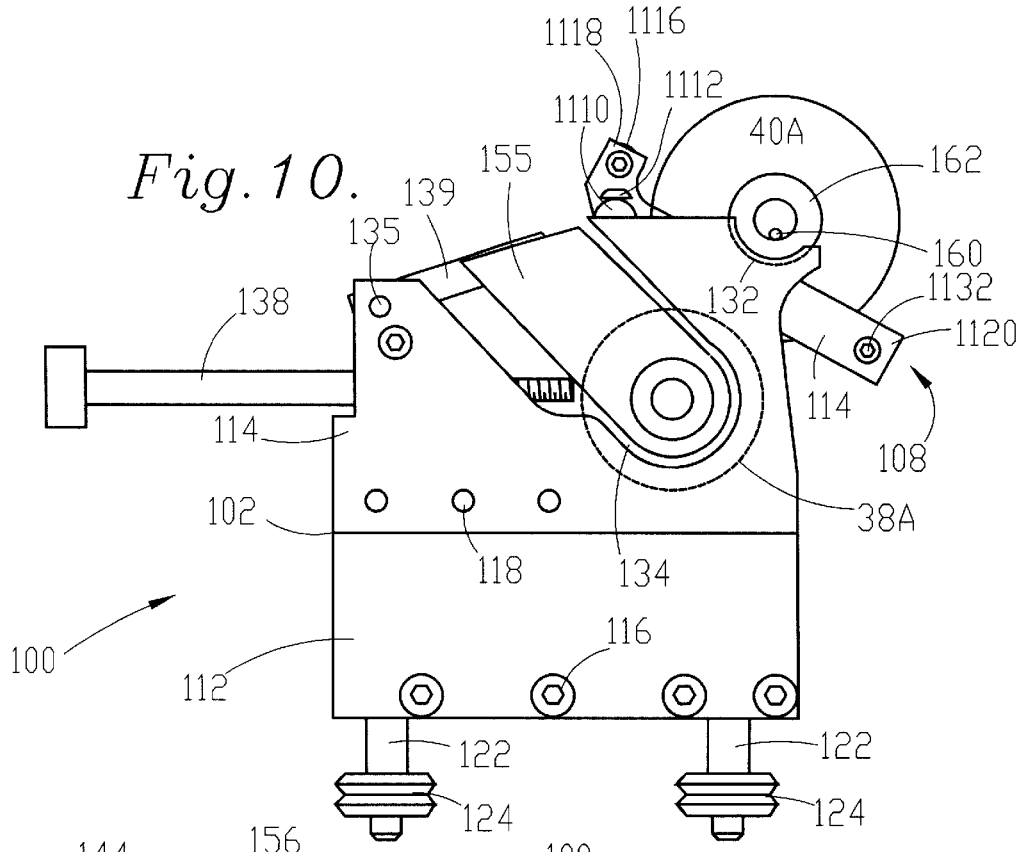
FIG. 10 is a slightly enlarged, opposite side view of the number one print station of FIG. 3.

Referring to FIGS. 8 and 9, the lock mechanism 106 operates to lock the carriage 102 in the operative position adjacent to the central cylinder 22, and it includes a pair of pivoting lock arms 1100 pivotally mounted on a pivot shaft 1102 extending between the side walls 24, 26 of the press. The pivot arms include an upwardly extending protrusion 1104 having a triangular configuration defining an inclined engagement surface 1106 which progressively engages the rounded surface of the lock shaft 128 to urge the movable carriage into the operable position. The progressive engagement is forced by a pair of cylinders 1108, preferably pneumatic, which force the lock arms upwardly. As the protrusion engages the lock shaft 128, the protrusion extends into the locking gap 130 between the bottom plate 110 and the lock shaft 128. The cylinders 1108 preferably act on the lock arms 1100 at a point spaced from the protrusion 1104 to achieve a mechanical advantage in locking the carriage 102 in position.

Referring to FIGS. 7, 8, and 12, the doctor blade assembly 108 is mounted on the extension plates 114 by mounting dowels 1110 fastened to the extension plates 114 with dowel fasteners 1112. The mounting dowels 1110 are also attached to elongated doctor blade arms 1114 with blade arm fasteners 1 115. The blade arms 1114 are separated by a cylindrical spacer bar 1116 at exposed ends 1118 of the doctor blade arms 1114. The opposite/unexposed ends 1120 of the doctor blade arms extend to the opposite side of the anilox roll and rotatably support a doctor blade shaft 1122 and a clamp bar 1124 which clamps a doctor blade 1126 therebetween. An outer, reduced diameter end 1128 of the blade shaft 1122 is rotatably received in an outer one of the blade arms 1114, and the inner end 1130 of the blade shaft is attached to the other blade arm by a blade shaft fastener 1132. The doctor blade comprises an upstream doctor blade in that it is positioned on the number one print station 100 that is on the upstream side 35 (FIG. 2) of the central impression cylinder 22 of the central impression press 20. The doctor blade 1126 is positioned to engage the anilox roll 40A between the meter roll 38A and the print roll 42A to scrape the anilox roll after it is inked by the meter roll but before the anilox roll transfers ink to the print roll. This requires that the doctor blade be positioned behind the anilox roll and between the central cylinder and the anilox roll where it is generally inaccessible to press operators.

The doctor blade is preliminary adjusted before the carriage is moved to the operative position by loosening the blade shaft fastener 1132 rotating the blade shaft 1122 and blade 1126 relative to the blade arms 1114. After the carriage is in the operative position, the upstream doctor blade is adjusted during operation by loosening the blade arm fasteners 1115 and adjusting the blade arms 1114 as desired. Without the movable carriage 102, there is no access to the doctor blade 1126 making commercial use of an upstream doctor blade unfeasible, but the movable carriage makes it both commercially feasible and desirable to use upstream doctor blades in central impression presses.

Referring to FIGS. 1 and 2, the print roll 42A is mounted on opposed adjustment arms 56A allowing the print roll 42A to be properly positioned. The meter roll 38A takes ink 58A from the ink tray 36A and transfers the ink to the anilox roll 40A. The doctor blade 1126 scrapes against the anilox roll to remove excess ink, and the anilox roll inks the print roll 42A. The print roll then transfers the ink to the web 30. The central cylinder 22 and the print rolls 42A, 42B, 42C are preferably driven by the same drive assembly to achieve the desired registration of the ink applied by the print stations 100, 200, 300.

To move the carriage 102 from the operative position to the retracted position, the print roll 42A is removed, and the cylinders 1108 are deactivated to lower the protrusions 1104 of the lock arms 1100 out of engagement with the lock shaft 128. The operator then rolls the carriage 102 until the rear, inner wheel contacts the wheel stop 176 holding the carriage in the retracted position. To move the carriage into a removed position away from the base 54 of the press, the guide track extension 174 is attached with the hook 180 and extension fastener 184 prior to moving the carriage into the retracted position. Once the wheel contacts the wheel stop, the carriage is then pulled outwardly away from the press. To put the carriage back in the operative position, the operator moves the carriage near the operative position and then activates the cylinders 1108 forcing the protrusion 1104 into the locking gap 130 and into engagement with the lock shaft 128.

Still referring to FIGS. 1 and 2, the number two print station 200 is a downstream print station positioned on a downstream side 37 of the central cylinder 22, and it also includes the movable carriage 202, which supports an ink tray 36B, a meter roll 38B, and an anilox roll 40B. The movable carriage 202 is supported by a second guide track assembly 204 and selectively held in position by a second lock mechanism 206. The second print station 200 also includes a second doctor blade assembly 208 adjustably mounted on the carriage 202, and a print roll 42B adjustably mounted by adjustment arms 56B on the side walls 24, 26 of the press 20. The second carriage 202 has similar components to the first carriage 102, but they are differently configured to account for the different space constraints of the second print station 200.

Figure 16:
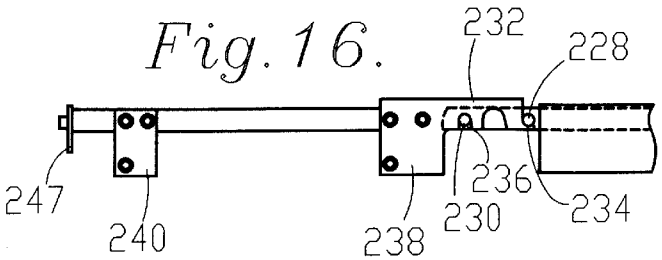
FIG. 16 is a fragmentary side view of the guide track assembly of the number two print station.
Figure 15:
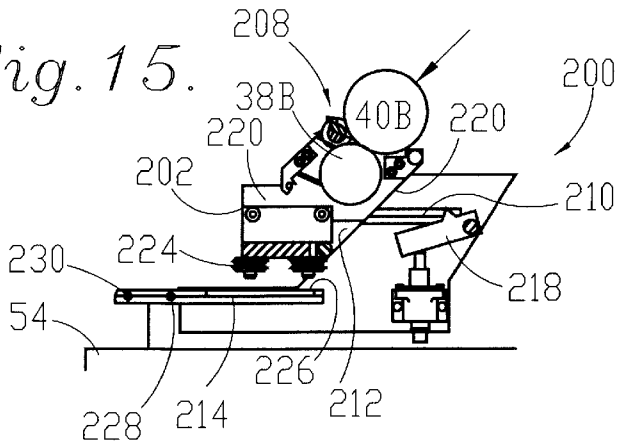
FIG. 15 is a side view of the number two print station.
Figure 6:
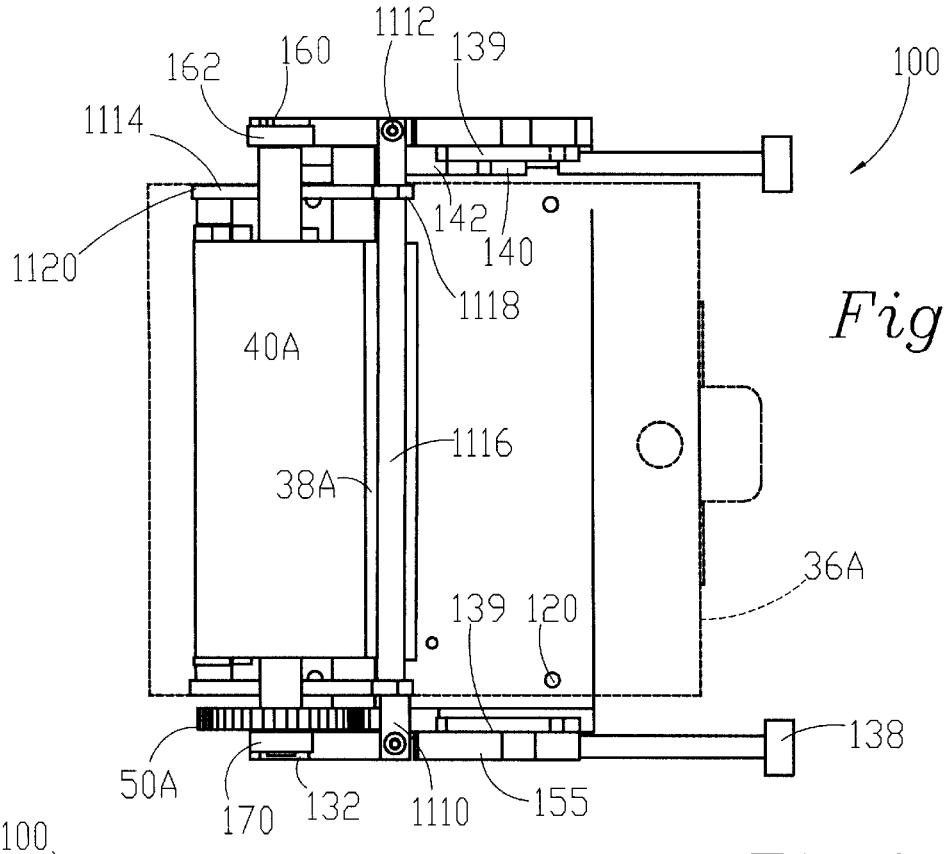
FIG. 6 is a top view of the number one print station of FIG. 3.

Referring additionally to FIGS. 5, 15, and 16, the second guide track assembly 204 has an upper fixed pair of opposed tracks 210, a diagonal slide 212, a lower fixed pair of opposed tracks 214, and a removable extension track 216. After removing the print roll 42B and releasing the lock arms 218 of the lock mechanism 206, the second print station 200 is rolled horizontally and parallel to the press' longitudinal axis, the carriage 202 then slides downwardly at an incline to avoid a reinforcing member (not shown) of the press 20. This is necessary when retrofitting a press with the quick change print stations. Because minimal structural changes are made to the press to retrofit the quick change print stations, this is favorable to purchasing a new press. However, a press originally designed with the quick change print stations could avoid some design features such as the diagonal slide.

To facilitate the downward slide, the front edges of the carriage extension plates 220 have inclined surfaces 222 similarly angled to the diagonal slide 212. Further, the wheels 224 are spaced from the inclined front edges 222, so that there is satisfactory clearance for the carriage to slide down. The lower tracks 214 have wheel openings 226 in the upper surface, so that the wheels 124 can pass into the V-shaped tracks. The extension portion 216 is attached to the lower track 214 prior to moving the carriage 202. The lower track has forward pins 228 and rearward pins 230, and the extension 216 has attachment plates 232 with forward lips 234 and downwardly facing rearward slots 236. The forward lips 234 engage the forward pins 228, and the rearward slots receive the rearward pins 230 to attach the removable extension portion 216.

The removable extension portion 216 also has front and rear support legs 238, 240 with reinforcing cross members 242, 244. A rear wheel stop 247 is positioned on one side of the extension at the rear end thereof. The rear wheel stop 247 engages a rear inner one of the wheels 224 to inhibit the carriage from rolling off the guide track assembly 204.

Referring to FIGS. 13 and 14, the doctor blade assembly 208 is mounted to the side plate extensions 220 with blade fasteners 246. One of the fasteners extends into and fixes an inner shaft 248 which extends into a recess 250 on an end of a doctor blade shaft 252. The other fastener attaches and fixes a collar shaft 254. Two collars 256, 258 are attached to each other, and the outer collar 256 is tightened on the collar shaft 254. The inner collar 258 is tightened on a reduced diameter end portion 259 of the blade shaft which is opposite the recess 250. A clamp bar 260 clamps a doctor blade 262 between it and the blade shaft 252. To adjust the doctor blade 262, the inner collar 258 is loosened and the blade shaft 252 is rotated in the outer collar and on the inner shaft.

Referring back to FIGS. 1 and 2, the number three print station 300 is a downstream print station positioned on a downstream side 37 of the central cylinder 22, and it also includes the movable carriage 302, which supports an ink tray 36C, a meter roll 38C, and an anilox roll 40C. The movable carriage 302 is supported by a third guide track assembly 304 and selectively held in position by a third lock mechanism 306. The third print station 300 also includes a third doctor blade assembly 308 adjustably mounted on the carriage 302, and a third print roll 42C adjustably mounted by adjustment arms 56C on the side walls 24, 26 of the press 20. The third carriage 302 has similar components to the first carriage 102, but they are differently configured to account for the different space constraints of the third print station 300. Additionally, the doctor blade assembly 308 is substantially identical to the second doctor blade assembly 208.

The third track assembly 304 includes a fixed track 310 and a removable track extension 312. The extension 312 attaches to the fixed track 310 similarly to the extension 216 of the second print station 200. The lock mechanism 306 has horizontally actuating cylinders 314, and the lock arms 316 have arcuate lock shaft engagement surfaces 318, which are preferably portions of a circle, formed at ends spaced from the cylinders 314.

In operation, the web 30 is fed from the feed roll 28 to the central impression cylinder 22. If one of the rolls is contaminated by foreign debris, the printing process can be paused and the debris quickly and effectively removed by using the features of the quick change print stations. Because the process is paused, there is little or no risk of injury. Even if an operator tries to clean a roll while the press is running, the shear pin 160 will shear off ceasing rotation of the anilox roll 40A and the meter roll 38A substantially reducing the chance of serious injury. Once a printing job is complete, the reduced amount of time necessary to change the anilox rolls for the next job increases the likelihood that they will be changed thereby increasing print quality.

Although preferred forms of the invention have been described above, it is to be recognized that such disclosure is by way of illustration only, and should not be utilized in a limiting sense in interpreting the scope of the present invention. Modifications to the exemplary embodiments, as herein above set forth, could be readily made by those skilled in the art without departing from the spirit of the appended claims.

The inventor hereby states the intent to rely on the Doctrine of Equivalents to determine and assess the reasonably fair scope of the invention as pertains to any apparatus or method not materially departing from but outside the literal scope of the invention as set out in the following claims.

I claim:

1. A central impression printing press for transferring ink in a desired pattern to a web, the printing press comprising:

a rotating central impression cylinder;

a first quick change print station operatively positioned relative to the central impression cylinder, and the first print station including a plurality of rotating first rolls and a first movable carriage rotatably mounting at least one of the first rolls, and the first movable carriage being movable between a first operative position and a first retracted position spaced away from the central impression cylinder;

a second quick change print station operatively positioned relative to the central impression cylinder at a location spaced apart from the first print station, and the second print station including a plurality of rotating second rolls and a second movable carriage rotatably mounting at least one of the second rolls, and the second movable carriage being movable between a second operative position and a second retracted position spaced away from the central impression cylinder;

first guide tracks supporting the first movable carriage during movement between the first operable position and the first retracted position, and second guide tracks supporting the second movable carriage during movement between the second operable position and the second retracted position; and first guide tracks comprise a fixed portion and a removable portion, the removable portion having an aligned position in which the removable portion is aligned with the fixed portion for movement of the first movable carriage and a stored position.

2. The printing press according to claim 1 wherein the removable portion comprises a first top plate and a second top plate spaced apart from the first top plate to allow a carriage wheel to pass therebetween.

3. The printing press according to claim 2 wherein the removable portion comprises an alignment plate positioned between the first and second top plates and engaging the carriage wheel to maintain carriage wheel alignment with the first guide tracks.

4. The printing press according to claim 1 wherein the removable portion defines a plurality of wheel openings, and the first movable carriage includes a plurality of carriage wheels sized and spaced to pass through the openings for separation of the first carriage from the removable portion.

5. The printing press according to claim 4 wherein the removable portion includes a retractable stop pin extending through a top plate in a position to engage the first carriage prior to the alignment of the carriage wheels with wheel openings.

* * * * *

UNITED STATES PATENT AND TRADEMARK OFFICE

CERTIFICATE OF CORRECTION

PATENT NO. : 6,283,024 B1
DATED : September 13, 2001
INVENTOR(S) : John George

It is certified that error appears in the above-identified patent and that said Letters Patent is hereby corrected as shown below:

Claim 5,
Line 50, after "with" insert -- the --.

Signed and Sealed this

Twelfth Day of March, 2002

*Attest:*

*Attesting Officer*

JAMES E. ROGAN
*Director of the United States Patent and Trademark Office*